US005734224A

United States Patent [19]

Tagawa et al.

[11] Patent Number: 5,734,224

[45] Date of Patent: Mar. 31, 1998

[54] IMAGE FORMING APPARATUS AND METHOD OF MANUFACTURING THE SAME

[75] Inventors: Masahiro Tagawa; Toshihiko Miyazaki, both of Isehara; Masahito Niibe, Atsugi; Naoto Nakamura; Tadashi Kaneko, both of Isehara, all of Japan

[73] Assignee: Canon Kabushiki Kaisha, Tokyo, Japan

[21] Appl. No.: 906,096

[22] Filed: Aug. 5, 1997

Related U.S. Application Data

[63] Continuation of Ser. No. 332,406, Oct. 31, 1994, abandoned.

[30] Foreign Application Priority Data

Nov. 1, 1993 [JP] Japan ..... 5-273321
Dec. 21, 1993 [JP] Japan ..... 5-321800

[51] Int. Cl.[6] ..... H01J 61/35

[52] U.S. Cl. ..... 313/493; 313/495; 313/292

[58] Field of Search ..... 313/493, 484, 313/489, 495, 496, 514, 258, 288, 290, 292

[56] References Cited

U.S. PATENT DOCUMENTS 4,325,002 4/1982 Kobale et al. ..... 313/485
4,352,042 9/1982 Lorenz et al. ..... 313/485
4,692,662 9/1987 Wada et al. ..... 313/493
5,015,912 5/1991 Spindt et al. ..... 313/495
5,198,723 3/1993 Parker ..... 313/493

FOREIGN PATENT DOCUMENTS 58-107554 7/1983 Japan .
5-36363 2/1993 Japan .

*Primary Examiner*—Sandra L. O'Shea
*Assistant Examiner*—Vip Patel
*Attorney, Agent, or Firm*—Fitzpatrick, Cella, Harper & Scinto

[57] ABSTRACT

An image-forming apparatus comprises a rear plate bearing thereon electron-emitting devices, a face plate bearing thereon an image-forming member and arranged vis-a-vis the rear plate, a support frame arranged between the rear plate and the face plate to enclose the periphery of the space delimited by the plates and define the distance therebetween and spacers arranged between the face plate and the rear plate and designed to produce images on the image-forming member by irradiating the image-forming member with electrons emitted from the electron-emitting devices. The spacers are shorter than the distance between the face plate and the rear plate defined by the support frame and the spacers are rigidly bonded at least at an end thereof to the rear plate or the face plate by means of an adhesive agent.

29 Claims, 17 Drawing Sheets

IMAGE FORMING APPARATUS AND METHOD OF MANUFACTURING THE SAME

This application is a continuation of application Ser. No. 08/332,406, filed Oct. 31, 1994, now abandoned.

BACKGROUND OF THE INVENTION

1. Field of the Invention

This invention relates to a flat image-forming apparatus provided with an electron source and, more particularly, it relates to a low profile image-forming apparatus comprising one or more than one spacers arranged within a vacuum container and a method of manufacturing the same.

2. Related Background Art

In recent years, image-forming apparatuses comprising a large and heavy cathode ray tube have been largely replaced by those comprising a lightweight and low profile or flat display. While liquid crystal displays have been exploited for flat displays, they are still accompanied by certain problems to be solved including that of a dark screen and a narrow viewing angle. Emission type flat displays have been proposed as excellent alternatives to liquid crystal displays as they can generate bright fluorescent light by irradiating a fluorescent body with electron beams emitted from an electron source contained therein. An emission type flat display offers far brighter images and a wider viewing angle than a liquid crystal display. On the other hand, in order for a flat display comprising an electron source to operate satisfactorily to irradiate the fluorescent body with electron beams and produce images on the screen, the electron source, the fluorescent body and other components of the apparatus need to be contained within a vacuum container which is maintained to a degree of vacuum not exceeding $10^{-5}$ torr.

There are vacuum containers designed to withstand the atmospheric pressure and comprising one or more than one spacers arranged between a face plate and a rear plate. Japanese Utility Model Application Laid-Open No. 58-107554 discloses a vacuum container for a fluorescent display comprising a spacer arranged between a face glass substrate and an anode substrate and bonded thereto by means of frit glass as shown in FIG. 22 of the accompanying drawings. Referring to FIG. 22, a spacer 16 is disposed between a face glass substrate 15 and an anode substrate 11 and bonded thereto by means of pieces of frit glass **19*a*, 19*b* to produce a vacuum container or a cover glass. In FIG. 22, reference numeral 14 denotes a filament wire that operates as an electron beam source and reference numerals 13 and 12 respectively denote a control grid and a fluorescent cathode section, which are fitted to the inside of the vacuum container. Reference numeral 18 denotes a through bore for receiving an exhaust pipe 17 to be used for evacuating the vacuum container. The fluorescent cathode section of the fluorescent display shown in FIG. 22** is realized in the form of not a matrix but a single row of cathodes. Obviously, it was not designed for a large display screen.

An image-forming apparatus can be made to withstand the atmospheric pressure either by using thick face and rear plates or by arranging one or more than one spacers within the apparatus in order to enhance the strength of the apparatus. For an image-forming apparatus having a large display screen, the use of one or more than one spacers is recommendable from the viewpoint of producing an apparatus with a reduced weight.

Japanese Patent Application Laid-Open No. 5-36363 discloses an image-forming apparatus designed to withstand the atmospheric pressure and comprising flat anti-atmospheric-pressure spacers arranged at regular intervals, each spacer having a wedge-like profile at a portion thereof to be held in contact with the face plate of the apparatus. However, the image-forming apparatus disclosed in the above identified publication are accompanied by certain drawbacks. For instance, it requires rigorous control during the manufacturing process on the dimensional accuracy of the spacers and the possible undulation of the face and rear plates to be used with the spacers therebetween. Additionally, in the course of assembling, the spacers can damage the fluorescent body and the wires of the apparatus if they are not handled with utmost caution. Without rigorous control on the overall manufacturing and assembling process, such an apparatus as disclosed in the above identified document can come to show operational instability that is fatally detrimental to the reliability of the apparatus.

SUMMARY OF THE INVENTION

In view of the above described technological problems, it is therefore an object of the present invention to provide an image-forming apparatus that operates stably and reliably without requiring rigorous control on the overall manufacturing and assembling process.

It is another object of the present invention to provide a method of manufacturing an image-forming apparatus that operates stably and reliably without rigorous control on the overall manufacturing and assembling process.

According to an aspect of the present invention, the above objects and other objects are achieved by providing a method of manufacturing an image-forming apparatus comprising a rear plate bearing thereon electron-emitting devices, a face plate bearing thereon an image-forming member and arranged vis-a-vis said rear plate, a support frame arranged between said rear plate and said face plate to enclose the periphery of the space delimited by said plates and define the distance therebetween and spacers arranged between said face plate and said rear plate within the space and designed to produce images on said image-forming member by irradiating said image-forming member with electrons emitted from said electron-emitting devices, wherein said manufacturing method comprises steps of making said spacers shorter than the distance between said face plate and said rear plate defined by said support frame and bonding said spacers at least at an end thereof rigidly to said rear plate or said face plate by means of an adhesive agent.

According to another aspect of the present invention, there is provided an image-forming apparatus comprising a rear plate bearing thereon electron-emitting devices, a face plate bearing thereon an image-forming member and arranged vis-a-vis said rear plate, a support frame arranged between said rear plate and said face plate to enclose the periphery of the space delimited by said plates and define the distance therebetween and spacers arranged between said face plate and said rear plate within the space and designed to produce images on said image-forming member by irradiating said image-forming member with electrons emitted from said electron-emitting devices, wherein said spacers are shorter than the distance between said face plate and said rear plate defined by said support frame and said spacers are rigidly bonded at least at an end thereof to said rear plate or said face plate by means of an adhesive agent.

With an image-forming apparatus according to the invention, as a result of the arrangement that the spacers are made shorter than the distance between the face plate and the rear plate defined by the support frame and the spacers are rigidly bonded at least at an end thereof to the rear plate or the face plate by means of an adhesive agent, the image-forming apparatus is endowed with an enhanced strength with which it can withstand the atmospheric pressure and external impacts that may be applied thereto so that it can remain free from operational instability. In particular, the anti-atmospheric-pressure strength can be significantly enhanced by rigidly bonding the spacers at either end thereof to the rear plate and the face plate.

With a method of manufacturing an image-forming apparatus according to the invention, as a result of providing steps of making the spacers shorter than the distance between the face plate and the rear plate defined by the support frame, they can be brought close to and bonded rigidly to the rear plate or the face plate without the risk of being damaged during the bonding operation.

Additionally, since a gap is provided between the spacers and the face or rear plate during the operation of bonding the spacers to the face or rear plate, they need not be subjected to rigorous control in terms of dimensional accuracy. Still additionally, the face and rear plates do not need to be checked for possible undulation or stepped areas that may be given rise to by wires and the face plate and the rear plate can be aligned accurately without damaging the electron-emitting devices (including the device electrodes and the connecting wires) and the image-forming member because of the use of the spacers.

Finally, if the spacers are bonded to some of the so-called black stripes of the image-forming member on the face plate by means of an adhesive agent, the adhesive can penetrate into the black film material (e.g., black carbon) of the black stripes to strengthen the force with which the black film material is adhering to the face plate and make the image-forming member less liable to come off of the face plate.

DETAILED DESCRIPTION OF THE PREFERRED EMBODIMENTS

Now, the present invention will be described in greater detail by referring to FIGS. 1 through 21 of the accompanying drawings.

Figure 1:
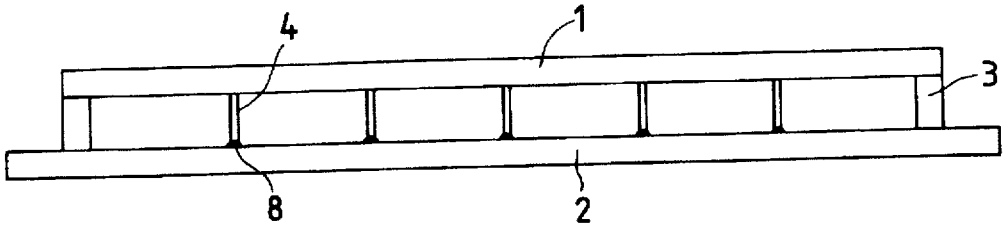
FIG. 1 is a schematic sectional side view of an embodiment of image-forming apparatus according to the invention.

FIG. 1 is a schematic sectional side view of an embodiment of an image-forming apparatus according to the invention. Referring to FIG. 1, the embodiment comprises a face plate bearing thereon an image-forming member 5, a rear plate bearing thereon a number of electron-emitting devices and a support frame 3, said face plate 1, said rear plate and said support frame being bonded together by means of a bonding agent to produce a hermetically sealed vacuum container. A number of spacers 4 are arranged between the face plate 1 and the rear plate in order to make the vacuum container withstand the atmospheric pressure. The spacers 4 are securely bonded to the rear plate 2 by means of respective adhesive members 8, although they may alternatively be bonded to the face plate 1 or to both the face plate 1 and the rear plate 2 also by means of respective adhesive members 8.

Figure 2:
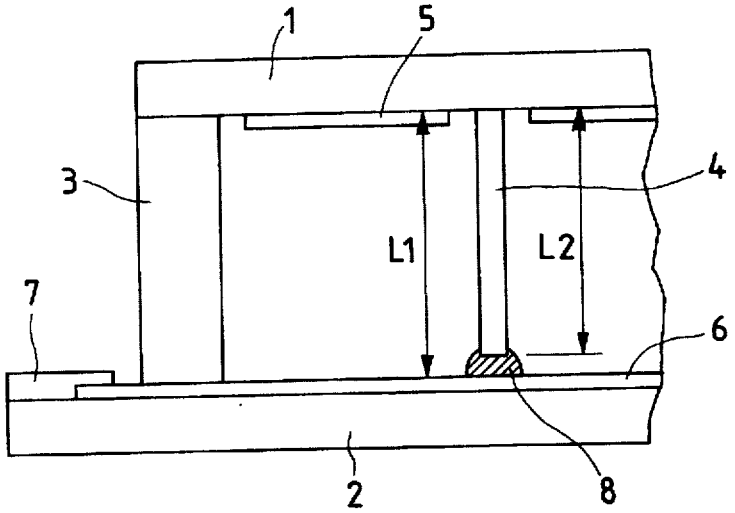
FIG. 2 is an enlarged schematic partial view of the embodiment of FIG. 1, showing part of the embodiment in greater detail.

FIG. 2 is an enlarged schematic partial view of the embodiment of FIG. 1, showing part of the embodiment in greater detail at a position close to the side wall thereof. Note that the same components are denoted respectively by the same reference numerals and symbols in FIGS. 1 and 2. Referring now to FIG. 2, reference numeral 5 denotes an image-forming member which comprises a black member that is often called a black matrix, a fluorescent body and a metal back as well as other components. Reference numeral 7 denotes a wire lead-out section. Each of the electron-emitting devices 6 has a wiring section drawn to the outside of the vacuum container through the support frame 3 and the rear plate 2 and electrically connected to a drive circuit by way of the wire lead-out section 7.

In FIG. 2, L1 denotes the distance between the face plate 1 and the rear plate 2 defined by the support frame 3 whereas L2 denotes the length of each spacer 4. As seen from FIG. 2, relationship L1>L2 is established for the purpose of the invention. The gap between each spacer 4 and the rear plate 2 defined by L1-L2 is filled with an adhesive member 8. Note that the face plate 1 and the support frame 3, the spacers 4 and the face plate 1 and the support frame 3 and the rear plate 2 are bonded by means of an adhesive agent, which is not shown for the sake of simplicity of illustration.

While the gap defined by L1-L2 is subject to change depending on the material of the adhesive member, it is preferably between 50 and 500 μm, more preferably between 50 and 300 μm and most preferably between 50 and 200 μm if frit glass is used for the adhesive member. If the gap is less than 50 μm, the bonding force of the frit glass would not be sufficient to hold the spacer and the face plate 1 together and an undesirable gap, if small, can remain between the spacer and the rear plate 2 after bonding the spacer to both the face plate 1 and the rear plate 2. If, on the other hand, the gap is more than 500 μm, the frit glass applied between the spacer and the rear plate 2 can flow out to cover an unintended area inside the vacuum container. While each piece of frit glass to be used to fill the gap between each spacer and the rear plate 2 has a height equal to or less than 500 μm, it can be appropriately and conveniently applied between the spacer and the rear plate 2 if it has a height equal to or less than 300 μm. It can be most conveniently applied between the spacer and the rear plate 2 and the possibility that the frit glass flows out can be minimized if it has a height equal to or less than 200 μm.

Figure 3:
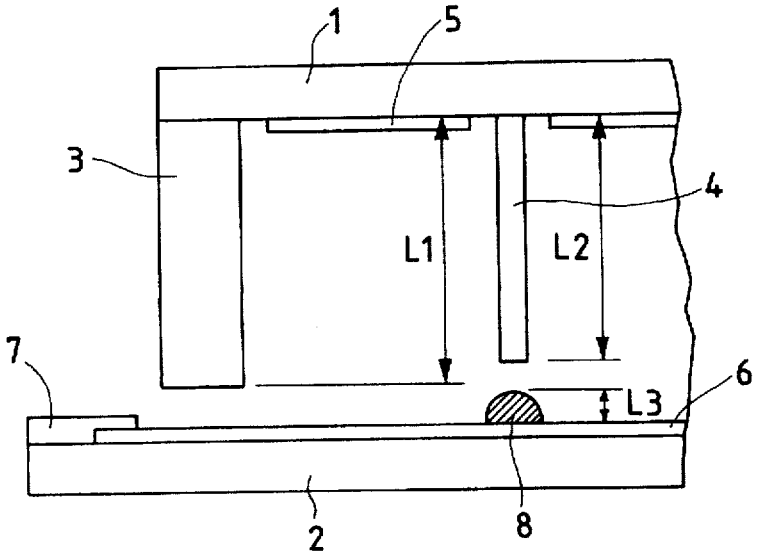
FIG. 3 is an enlarged schematic partial view of the embodiment of FIG. 1 similar to FIG. 2 but schematically illustrating a step of manufacturing the same.

FIG. 3 is an enlarged schematic partial view of the embodiment of FIG. 1 similar to FIG. 2 but schematically illustrating a step of manufacturing the same before it is brought into a hermetically sealed condition. Note that the same components are denoted respectively by the same reference numerals and symbols in FIGS. 2 and 3. In the manufacturing step shown in FIG. 3, an adhesive member 8 is placed between the spacer 4 and the rear plate 2 and calcined. Thereafter, the adhesive member 8 is baked to bond the spacer 4 and the rear plate 2 together to produce a finished image-forming apparatus as shown in FIG. 2.

As seen from FIG. 3, the adhesive member 8 placed on the rear plate 2 preferably has height L3 that is greater than the gap defined by L1-L2 when it has been calcined. The difference defined by L3-(L1-L2) is preferably equal to or greater than 20 μm in view of possible dimensional inaccuracy of the spacer and steps that may be given rise to there by wiring.

The shape and the number of spacers to be used in an image-forming apparatus according to the invention are not subject to any general restrictions and can be determined by considering the size of the display screen, the arrangement of pixels, the structure of the image-forming member and other design-related factors. While there are no restrictions concerning the positions where the spacers are arranged, they may preferably be placed on the black matrix because such an arrangement can minimize any possible negative effect of using spacers on the quality of images to be displayed.

It is preferable that the material of the spacers has a thermal expansion coefficient substantially equal to those of the materials of the support frame 3, the face plate 1 and the rear plate 2. Specifically speaking, the ratio of the thermal expansion coefficients is preferably between 0.8 and 1.2. Most preferably, a material having a thermal expansion coefficient practically equal to those of the materials of the support frame 3, the face plate 1 and the rear plate 2 should be selected for the spacers in order to minimize possible stresses and distortions that may appear on the vacuum container after it has been subjected to a heating operation.

While the spacers and the support frame may be provided as separate and independent components, they may alternatively be bonded together into an integral structure by means of etching or some other appropriate technique.

While any appropriate adhesive agent can be used for the adhesive member if it securely bonds the face plate 1, the rear plate 2 and the spacers 4 together, frit glass that is softened at a temperature below 410° C. may be a preferable choice. The adhesive members are preferably black-colored. It is preferable that the adhesive members are so composed as to show a thermal expansion coefficient substantially equal to those of the spacers, the support frame, the face plate and the rear plate.

Electron-emitting devices of different types can be used for an image-forming apparatus according to the invention. An example of electron-emitting devices that can be suitably used for the purpose of the invention is surface conduction electron-emitting devices (surface conductive emitters).

A surface conduction electron-emitting device is realized by utilizing the phenomenon that electrons are emitted out of a small thin film formed on a substrate when an electric current is forced to flow in parallel with the film surface.

Figure 4A:
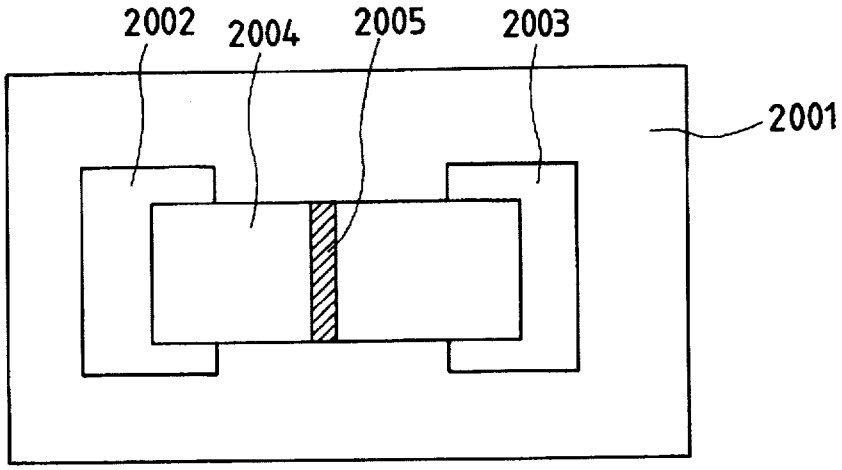
FIGS. 4A and 4B are respectively a plan view and a side view schematically illustrating an electron-emitting device that can be used for the purpose of the present invention.
Figure 4B:
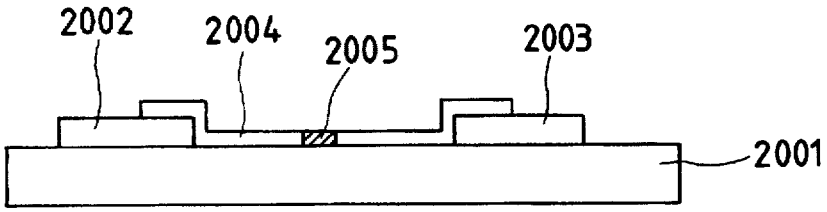

Now, a surface conduction electron-emitting device will be described by referring to FIGS. 4A and 4B, which schematically illustrate a plan view and a side view of the device respectively. In FIGS. 4A and 4B, reference numeral 2001 denotes a substrate that corresponds to the rear plate 2 of FIGS. 1 through 3. The device comprises a pair of device electrodes 2002, 2003 and an electroconductive thin film 2004 including an electron-emitting region 2005.

As a voltage is applied to the device electrodes 2002, 2003 to cause an electric current to flow through the electroconductive thin film 2004, electrons are emitted from the electron-emitting region 2005.

The substrate 2001 may be made of quartz glass containing impurities such as sodium at a low concentration or soda lime glass. Alternatively, it may be a $SiO_2$ coated glass substrate or a ceramic substrate containing alumina.

The device electrodes 2002, 2003 are typically made of a popular electroconductive material.

Materials that can be used for the electroconductive thin film 2004 include metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LAB_6$, $CeB_6$, $YB_4$ and $GdB_4$, carbides such TiC, ZrC, HfC, TaC, SiC and WC, nitrides such as TiN, ZrN and HfN, semiconductor substances such as Si and Ge and carbon.

The electron-emitting region 2005 comprises electrically highly resistive fissures formed in a part of the electroconductive thin film 2004. Normally, it is produced by a so-called electric forming process.

Now a method of manufacturing a surface conduction electron-emitting device will be described by referring to FIGS. 5A through 5C. Note that the same components are denoted respectively by the same reference numerals in FIGS. 4A through 5C.

Figure 5A:
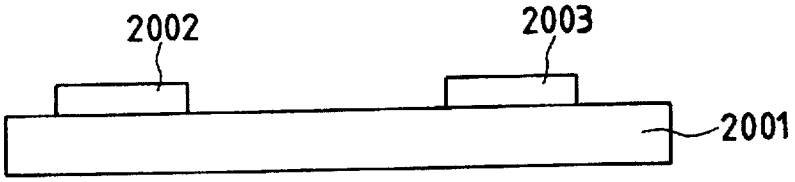
FIGS. 5A through 5C are side views of the electron-emitting device of FIGS. 4A and 4B illustrating three different steps of manufacturing the same.
Figure 5B:
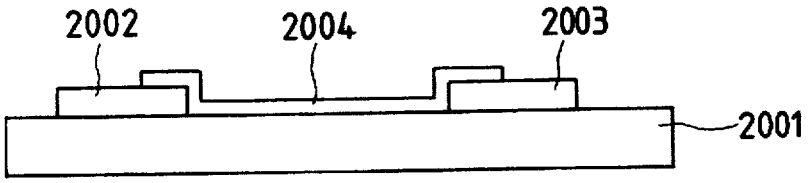
Figure 5C:
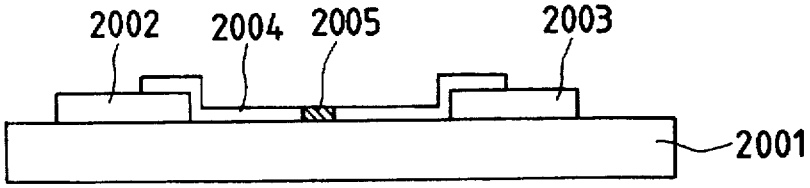

1) After thoroughly cleansing a substrate 2001 with detergent and pure water, a selected material is deposited on the substrate 1 by means of vacuum deposition, sputtering or some other appropriate technique for a pair of device electrodes 2002 and 2003, which are then produced by photolithography (FIG. 5A).

2) A thin film of an organic metal compound is formed on the substrate 2001 between the pair of device electrodes 2002 and 2003 by applying a solution containing the organic metal compound. Thereafter, the thin film of the organic metal compound is heated, baked and subsequently subjected to a patterning operation, using an appropriate technique such as lift-off or etching, to produce the electroconductive thin film 2004 (FIG. 5B).

3) Subsequently, the device is subjected to an electric forming process. In this forming operation, an electric current is caused to run between the device electrodes 2002 and 2003 by means of a power source (not shown) until a portion of the electroconductive thin film 2004 undergoes a structural change to form an electron-emitting region 2005 (FIG. 5C). Differently stated, the electroconductive thin film 2004 is locally destroyed, deformed or transformed such that a portion of the electroconductive thin film 2004 undergoes a structural change to become an electron-emitting region 2005. The voltage used for the electric forming operation preferably has a pulse waveform.

4) After the electric forming operation, the device is preferably subjected to an activation process, where a pulse voltage is repeatedly applied to the device in vacuum of a degree of $10^{-4}$ Torr to $10^{-5}$ Torr as in the case of the forming operation so that carbon or carbon compounds may be deposited on the device out of the organic substances existing in the vacuum in order to cause the device current If and the emission current Ie of the device to change markedly.

Now, an electron source substrate bearing thereon a number of surface conduction electron-emitting devices that can be suitably used for the rear plate of an image-forming apparatus according to the invention will be described.

Figure 6:
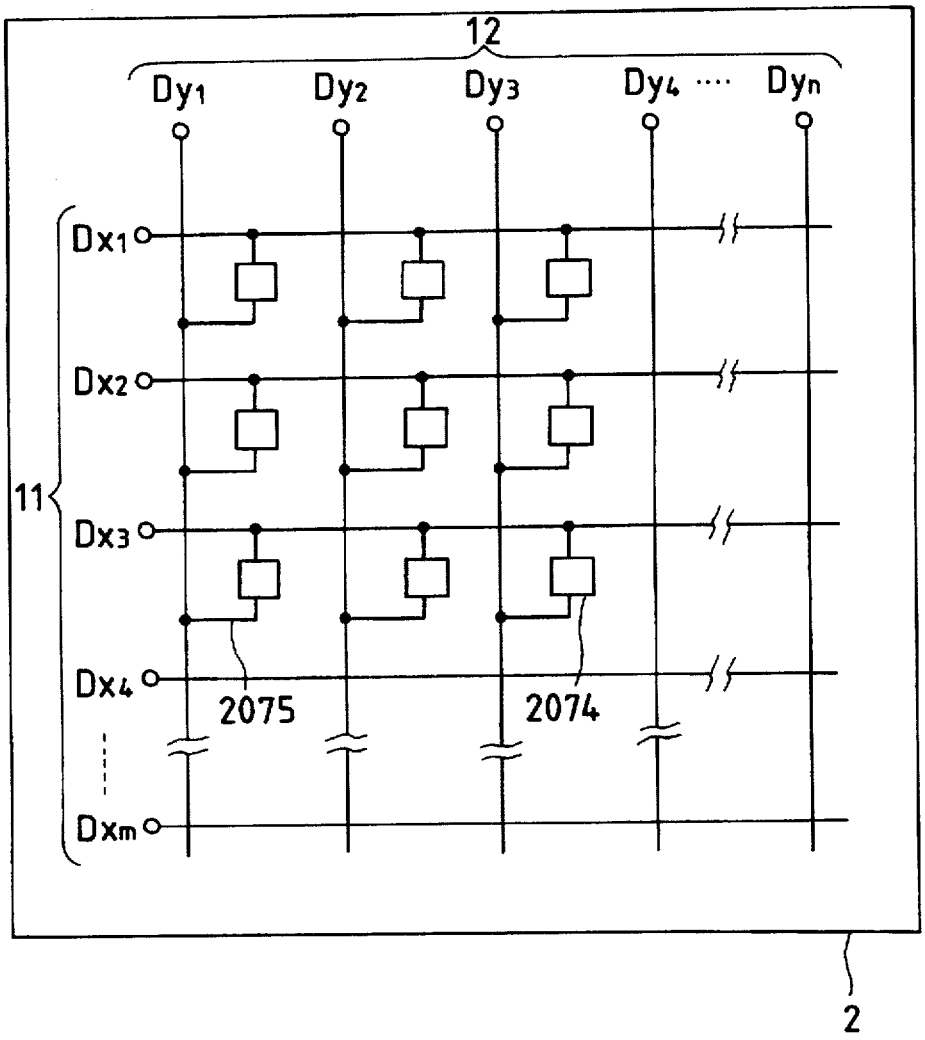
FIG. 6 is a schematic plan view of a simple matrix type substrate of an electron source that can be used for the purpose of the present invention.

While surface conduction electron-emitting devices can be arranged on an electron source substrate in a number of different ways, a simple matrix arrangement will be described here by referring to FIG. 6. In FIG. 6, the electron source substrate 2 comprises X-directional wirings 11, Y-directional wirings 12, surface conduction electron-emitting devices 2074 and connecting wires 2075. The electron source substrate 2 may be a glass substrate as described earlier and the shape of the substrate may be appropriately determined in view of the application of the image-forming apparatus and other considerations.

There are provided a total of m X-directional wirings 11, which are designated by DX1, DX2, . . . , DXm and a total of n Y-directional wirings 12 are arranged and designated by DY1, DY2, . . . , DYn. These wirings are so designed in terms of material, thickness and width that, if necessary, a substantially equal voltage may be applied to the surface conduction electron-emitting devices. An interlayer insulation layer (not shown) is disposed between the m X-directional wirings 11 and the n Y-directional wirings 12 to electrically isolate them from each other, the m X-directional wirings and n Y-directional wirings forming a matrix.

The interlayer insulation layer (not shown) is formed on the entire surface of part of the surface of the substrate 2, where the X-directional wirings 11 are arranged, to show a desired contour. Each of the X-directional wirings 11 and the Y-directional wirings 12 is drawn out to form an external terminal.

The oppositely arranged electrodes (not shown) of each of the surface conduction electron-emitting devices 2074 are connected to the related one of the m X-directional wirings 11 and the related one of the n Y-directional wirings 12 by respective connecting wires 2075.

The surface conduction electron-emitting devices may be arranged directly on the substrate or on the interlayer insulation layer (not shown).

The X-directional wirings 11 are electrically connected to a scan signal generating means (not shown) for selecting a row of surface conduction electron-emitting devices 2074 arranged along the X-direction according to an input signal.

On the other hand, the Y-directional wirings 12 are electrically connected to a modulation signal generating means (not shown) for applying a modulation signal to a column of surface conduction electron-emitting devices 2074 arranged along the Y-direction according to an input signal.

Note that the drive signal to be applied to each surface conduction electron-emitting device is supplied as the voltage difference of the scan signal and the modulation signal applied to the device.

With the above described simple matrix wiring arrangement, individual electron-emitting devices can be independently selected and driven to operate.

Figure 7:
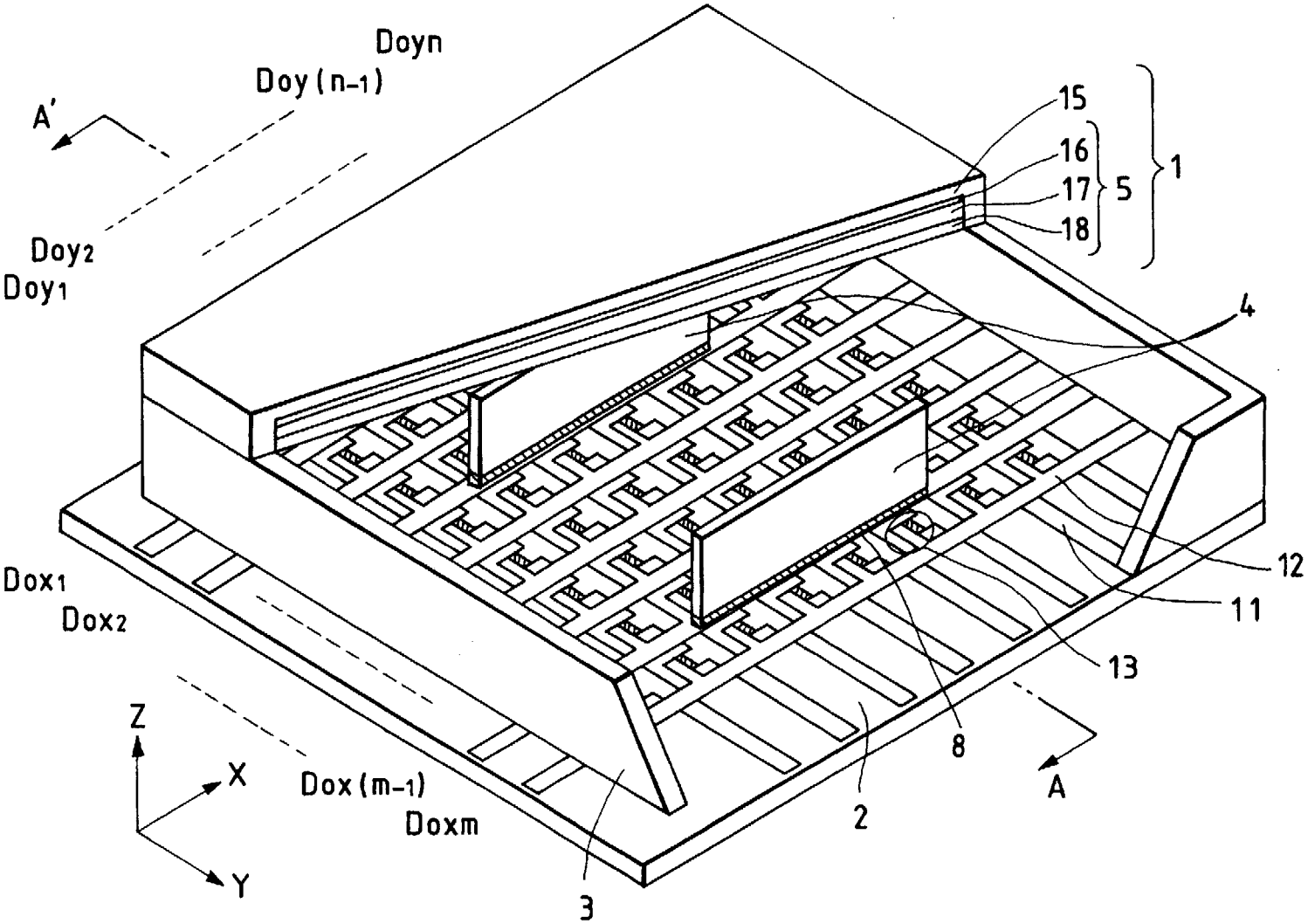
FIG. 7 is a schematic perspective view of another embodiment of an image-forming apparatus according to the invention, showing the inside by tearing off part of the apparatus.

An image-forming apparatus according to the invention will now be described by referring to FIG. 7. FIG. 7 is a schematic perspective view of an embodiment of an image-forming apparatus according to the invention, showing the inside by tearing off part of the apparatus. In FIG. 7, the embodiment comprises a face plate 1 made of a glass plate 15 and bearing thereon an image-forming member 5, which is formed by assembling a black member 16, often called a black matrix, a fluorescent body 17 and a metal back 18, and a rear plate 2 bearing thereon wirings 11 and 12 arranged to a matrix, an interlayer insulation layer (not shown) and a number of electron-emitting devices 13. The face plate 1 and the rear plate 2 are put together with a support frame 3 interposed therebetween and these components are bonded together to produce a hermetically sealed vacuum container. A number of spacers 4 are disposed between the face plate 1 and the rear plate 2 in order to make the vacuum container withstand the atmospheric pressure. The spacers 4 are arranged on the wirings 12 by using respective adhesive members 8. To drive the image-forming apparatus to operate, voltages are applied thereto by way of terminals Dox1 through Doxm that correspond to the wirings 11 and terminals Doy1 through Doyn that correspond to the wirings 12. More specifically, the terminals Dox1 through Doxm are designed to receive scan signals for sequentially driving on a one-by-one basis the rows (of a total of N devices) of surface conduction electron-emitting devices arranged in the form of a matrix having M rows and N columns in the electron source. On the other hand, terminals Doy1 through Doyn are designed to receive a modulation signal for controlling the output electron beam of each of the surface-conduction type electron-emitting devices of a row selected by a scan signal. A high voltage terminal (not shown) is fed with a DC voltage which is sufficiently high to accelerate electron beams emitted from the selected surface-conduction type electron-emitting devices in order to provide the beams with sufficient energy to excite the fluorescent body.

A scan circuit that can be used for ordinary display apparatuses can also be used for an image-forming apparatus according to the invention. The NTSC television signal system, the TV signal system to be used is not limited to a particular one and any other system such as PAL or SECAM may feasibly be used with an image-forming apparatus according to the invention. An image-forming apparatus according to the invention is particularly suited for TV signals involving a larger number of scanning lines typically of a high definition TV system such as the MUSE system because it can be used for a large display panel comprising a large number of scanning lines.

Now, the present invention will be described further by way of examples, although the present invention is not limited thereto and modifications and alterations can be made thereto within the spirit and scope of the invention.

EXAMPLE 1

In an experiment, an image-forming apparatus having a configuration as schematically illustrated in FIG. 7 was prepared. In the experiment, the glass plate 15, the rear plate 2 and the support frame 3 were formed by cutting panels of soda lime glass. Flat spacers 4 were prepared by polishing panel-shaped thin pieces of glass. Of the components of the image-forming member 5 of the face plate 1, the black matrix 16 was made of a material containing graphite as a principal ingredient and the fluorescent body 17 comprised phosphors of three primary colors while an aluminum film formed by vapor deposition was used for the metal back 18. The spacers 4 were bonded to the wirings 12 formed on the rear plate 2 by means of frit glass 8. In this example, the distance defined by L1-L2 of FIG. 2 was made equal to 250 μm. Surface conduction electron-emitting devices were produced on the rear plate 2 by means of photolithography for the electron-emitting device 13. The lower wirings 11, the interlayer insulation film ($SiO_2$) and the upper wirings 12 were arranged in layers to form a matrix of wirings also by means of photolithography.

Now, the steps of manufacturing the rear plate 2 bearing thereon electron-emitting devices 13 will be described in detail by referring to FIGS. 8 through 11H.

Figure 8:
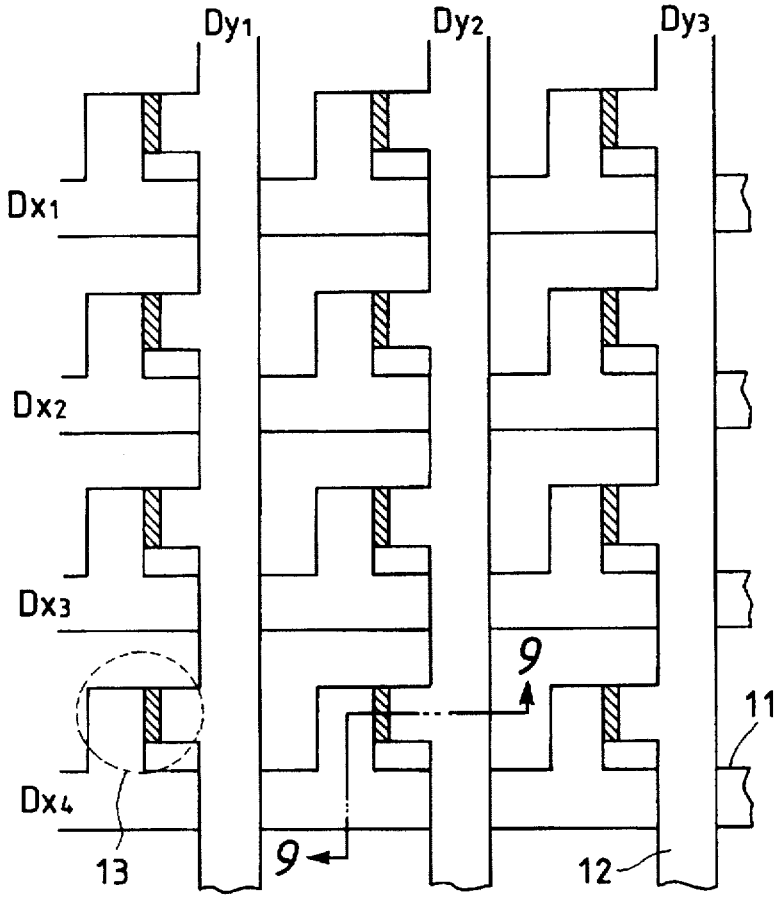
FIG. 8 is a schematic partial view of the matrix of wiring of an electron source that can be used for the purpose of the present invention.
Figure 9:
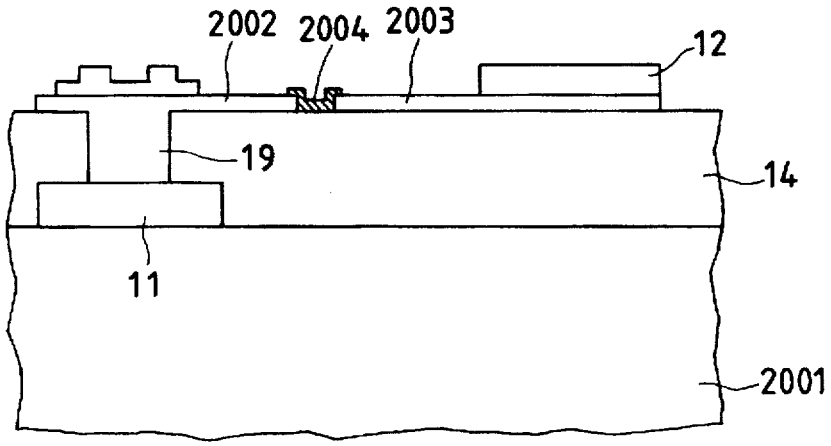
FIG. 9 is a schematic partial sectional view of the electron source of FIG. 8.

As shown in FIG. 8, the lower wirings 11 and the upper wirings 12 are arranged to form a matrix and an electron-emitting device 13 is formed on each of the crossings of wirings. FIG. 9 is a schematic partial sectional view of the rear plate 2 taken along line 9—9 in FIG. 8. In FIG. 9, reference numeral 2001 denotes a substrate which is in fact the rear plate 2 of FIG. 7 and reference numeral 14 denotes an interlayer insulation layer for electrically isolating the lower wiring 11 and the upper wiring 12 from each other, said wirings 11 and 12 being allocated to the specific surface conduction electron-emitting device shown there. Reference numerals 2002 and 2003 denote a pair of device electrodes of the surface conduction electron-emitting device and reference numeral 2004 denotes the electroconductive thin film of the device in which an electron-emitting region is produced. Reference numeral 19 denotes a contact hole for electrically connecting the device electrode 2002 and the lower wiring 11. The structure of FIG. 9 was prepared by following the steps described below by referring to FIGS. 10A through 10D and 11E through 11H. Note that the same components are denoted respectively by the same reference numerals in FIGS. 9 through 11H.

Figure 10A:
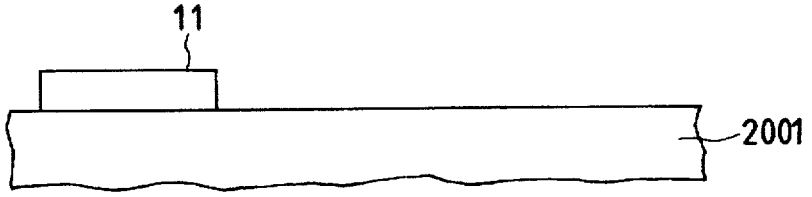
FIGS. 10A through 10D and 11E through 11H are schematic partial sectional side views of the electron source of FIG. 8, illustrating different steps of manufacturing the same.

Step a:

After thoroughly cleansing a soda lime glass plate a silicon oxide film was formed thereon to a thickness of 0.5 microns by sputtering to produce a substrate 2001, on which Cr and Au were sequentially laid to thicknesses of 50 angstroms and 6,000 angstroms respectively and then a photoresist (AZ1370: available from Hoechst Corporation) was formed thereon by means of a spinner, while rotating the film, and baked. Thereafter, a photo-mask image was exposed to light and developed to produce a resist pattern for a lower wiring 11 and then the deposited Au/Cr film was wet-etched to produce a lower wiring 11 (FIG. 10A).

Figure 10B:
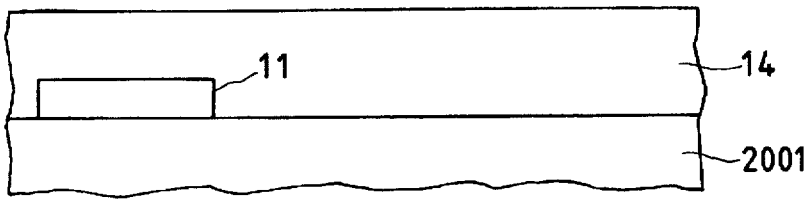

Step b:

A silicon oxide film was formed as an interlayer insulation layer 14 to a thickness of 1.0 micron by RF sputtering (FIG. 10B).

Figure 10C:
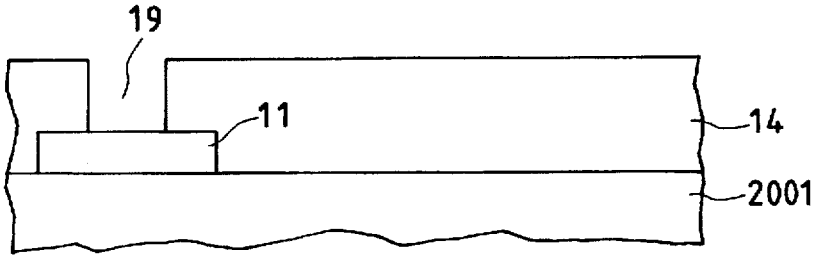

Step c:

A photoresist pattern was prepared for producing a contact hole 19 in the silicon oxide film 14 deposited in Step b, which contact hole 19 was then actually formed by etching the interlayer insulation layer 14, using the photoresist pattern for a mask (FIG. 10C). A technique of RIE (Reactive Ion Etching) using $CF_4$ and $H_2$ gas was employed for the etching operation.

Figure 10D:
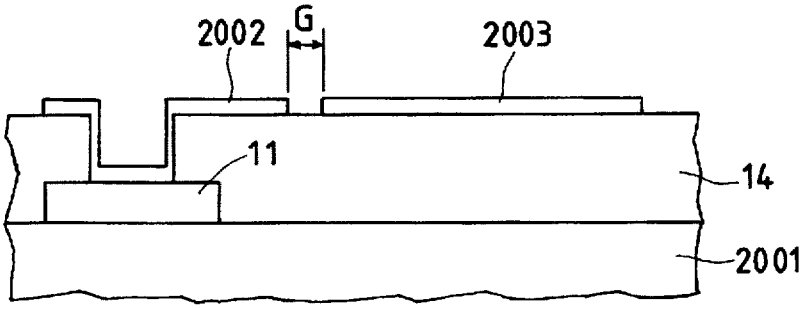

Step d:

Thereafter, a pattern of photoresist (RD-2000N-41: available from Hitachi Chemical Co., Ltd.) was formed for a device electrode 2002 and a gap G separating a pair of electrodes including the electrode 2002 and then Ti and Ni were sequentially deposited thereon respectively to thicknesses of 50 Å and 1,000 Å by vacuum deposition. The photoresist pattern was dissolved by an organic solvent and the Ni/Ti deposit film was treated by using a lift-off technique to produce a pair of device electrodes 2002 and 2003 having a width of 300 microns and separated from each other by a distance G of 3 microns (FIG. 10D).

Figure 11E:
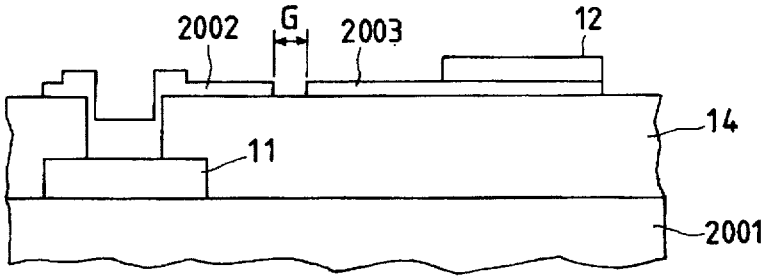

Step e:

After forming a photoresist pattern on the device electrodes 2002, 2003 for an upper wiring 12, Ti and Au were sequentially deposited by vacuum deposition to respective thicknesses of 50 angstroms and 5,000 angstroms and then unnecessary areas were removed by means of a lift-off technique to produce an upper wiring 12 (FIG. 11E).

Figure 11F:
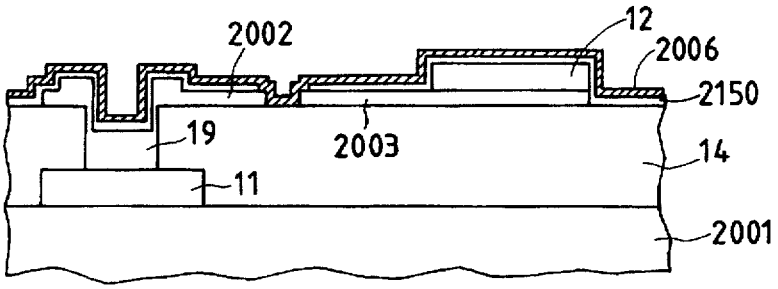

Step f:

A mask was used to form a Cr film 2150 to a film thickness of 1,000 Å by vacuum deposition, which was then subjected to a patterning operation. Thereafter, an organic Pd compound (ccp4230: available from Okuno Pharmaceutical Co., Ltd.) was applied to the Cr film by means of a spinner, while rotating the film, and baked at 300° C. for 10 minutes (FIG. 11F). The formed electroconductive thin film 2004 was made of fine particles containing Pd as a principal ingredient and had a film thickness of 100 angstroms and a sheet electric resistance of $5\times10^4\Omega/\square$.

Figure 11G:
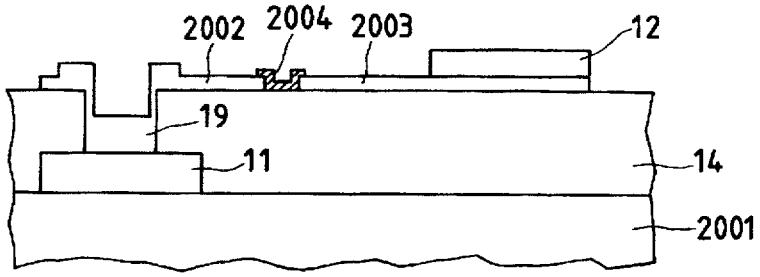

Step g:

The Cr film 2150 and the baked electroconductive thin film 2004 were etched by using an acidic etchant to produce a desired pattern (FIG. 11G).

Figure 11H:
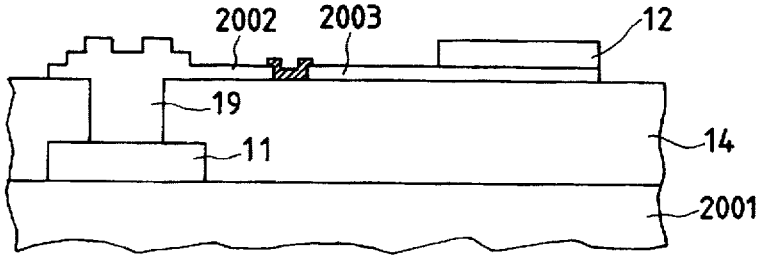

Step h:

Then, a pattern for applying photoresist to the entire surface area except the contact hole 19 was prepared and Ti and Au were sequentially deposited by vacuum deposition to respective thicknesses of 50 angstroms and 5,000 angstroms. Any unnecessary areas were removed by means of a lift-off technique to consequently bury the contact hole 19 (FIG. 11H).

By following the above steps, a lower wiring 11, an interlayer insulation layer 14, an upper wiring 12, a pair of device electrodes 2002, 2003 and an electroconductive thin film 2004 were formed on an insulating substrate 1.

Now, the process of assembling an image-forming apparatus according to the invention will be described in terms of an experiment by referring to FIGS. 12A through 12E.

A face plate 1 was prepared by forming an image-forming member on a glass plate.

Figure 12A:
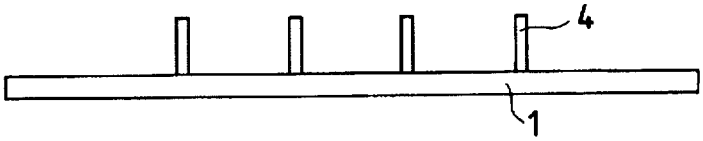
FIGS. 12A through 12E are schematic sectional side views of still another embodiment of an image-forming apparatus according to the invention, illustrating different steps of manufacturing the same.

Then, frit glass was applied onto the face plate 1 by using a printing technique and the applied frit glass was calcined in order to remove the resin contained in the frit glass. The frit glass showed a thickness of 300 μm after the calcining operation. The calcining operation was carried out by keeping it under a heated condition, where the frit glass having a softening temperature of 490° C. was held to 480° C. for approximately ten minutes. Thereafter, a given number of anti-atmospheric-pressure spacers 4 were placed on the calcined frit glass to show a given pattern of arrangement. Then, the frit glass was baked at it was heated at 550° C. and kept under a heated condition for approximately ten minutes so that the spacers 4 were rigidly bonded to the face plate 1 (FIG. 12A).

Figure 12B:
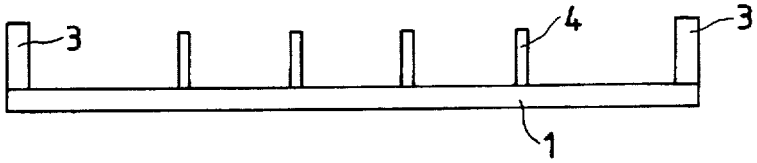

Then, a support frame 3 was bonded to the face plate 1 in a manner as described above by referring to FIG. 12A. Here, frit glass having a softening temperature of 410° C. was calcined at 400° C. and baked at 450° C. for approximately ten minutes under a heated condition (FIG. 12B).

Figure 12C:
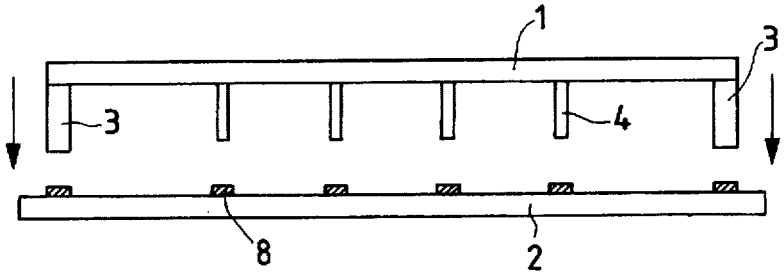
Figure 12D:
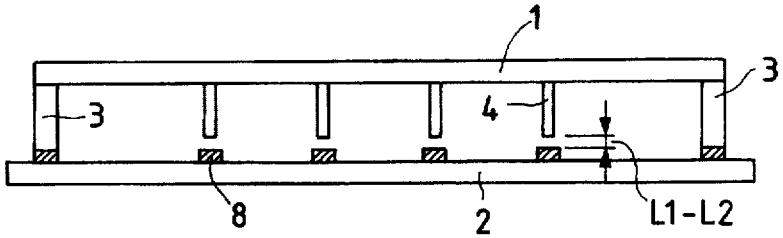

Thereafter, frit glass 8 was applied onto the wirings of a rear plate 2 bearing thereon a given number of electron-emitting devices and then calcined under a heated condition, where the frit glass having a softening temperature of 410° C. was held to 400° C. for approximately ten minutes. The frit glass showed a thickness of about 150 μm after the calcining operation (FIG. 12C). The face plate 1 was placed in alignment with the rear plate 2 and rigidly bonded thereto. Since each of the anti-atmospheric-pressure spacers 4 had a height smaller than that of the support frame 3, the anti-atmospheric-pressure spacers 4 did not touch the frit glass calcined on the rear plate 2 so that the face plate 1 allowed fine positional adjustment to be conducted on the rear plate 2 after it had been preliminarily aligned with the rear plate 2 (FIG. 12D).

Figure 12E:
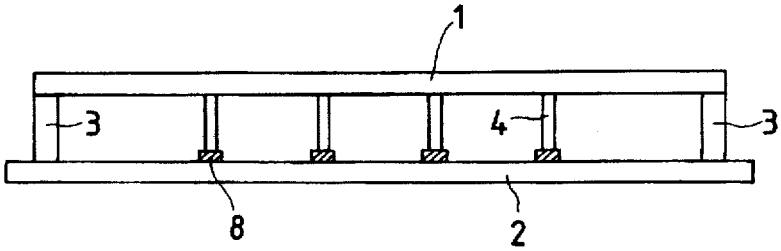

Then, the frit glass was baked as it was heated at 450° C. and kept under a heated condition for approximately ten minutes. Since the frit glass applied under the support frame 3 had a softening temperature equal to that of the frit glass applied under the anti-atmospheric-pressure spacers 4, they were softened as they were baked and the frit glass 8 located between the rear plate 2 and the support frame 3 partly lost its height until the anti-atmospheric-pressure spacers 4 came to touch the softened frit glass. Consequently, the anti-atmospheric-pressure spacers 4 and the calcined frit glass (hard frit glass) were relieved from any significant impact (and practically no impact was experienced) and the frit glass was found surrounding the anti-atmospheric-pressure spacers 4 when it was baked. In this manner, the image-forming apparatus was assembled to withstand the atmospheric pressure (FIG. 12E).

After the assembling operation was over, the vacuum container of the image-forming apparatus was evacuated by means of an exhaust pipe (not shown), which was then hermetically sealed to maintain the vacuum condition within the container.

By using anti-atmospheric-pressure spacers having a height smaller than the distance between the face plate 1 and the rear plate 2 defined by the support frame 3 as described above, the rear plate 2 could be aligned with the face plate 1 carrying thereon anti-atmospheric-pressure spacers 4 and a support frame 3 without any risk of damaging the electron-emitting devices and the image-forming member of the apparatus. Additionally, small errors, if any, in the height of the anti-atmospheric-pressure spacers could be neglected during the operation of assembling the image-forming apparatus and no distortions were observed in the produced image-forming apparatus. The image-forming apparatus was highly shock-proof and operated stably for a prolonged period of time in displaying images on its large screen.

While the anti-atmospheric-pressure spacers 4 and the support frame 3 had been bonded to the face plate 1 when the face plate 1 and the rear plate 2 were put together in the above experiment, the face plate 1 and the rear plate 2 may alternatively be assembled after bonding the spacers 4 and the support frame 3 to the rear plate 2. If such is the case, frit glass 8 as illustrated in FIGS. 12A through 12E is placed between each spacer 4 and the face plate 1. Still alternatively, the anti-atmospheric-pressure spacers 4 and the support frame 3 may be bonded to the face plate 1 and the rear plate 2 respectively.

While a same kind of frit glass was used in the above example to bond the support frame 3 to the face plate 1 and the rear plate 2, two different kinds of frit glass having different softening temperatures may alternatively be used. Still alternatively, crystalline frit glass may be used.

EXAMPLE 2

Figure 13:
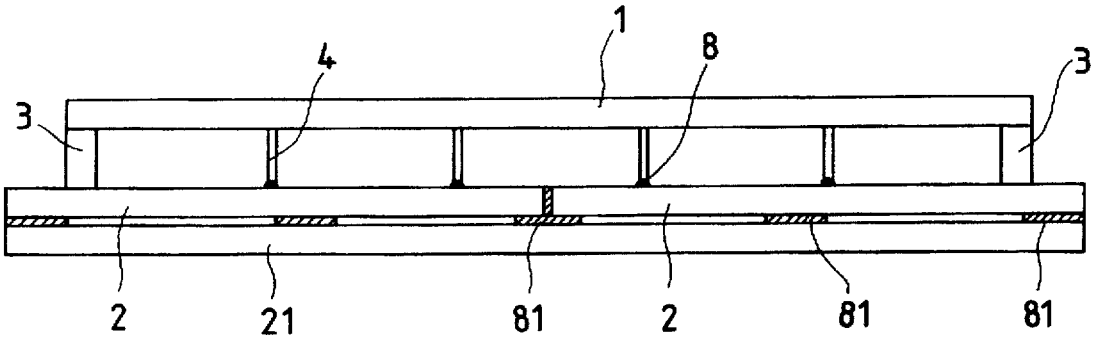
FIG. 13 is a schematic sectional side view of still another embodiment of an image-forming apparatus according to the invention.

In this example, an image-forming apparatus having a configuration schematically shown in FIG. 13 was prepared. The image-forming apparatus of this example differed from that of Example 1 in that the rear plate 2 was a composite plate comprising two component rear plates that were bonded together by means of a reinforcing plate 21 and frit glass 81 applied to the reinforcing plate 21.

Figure 14:
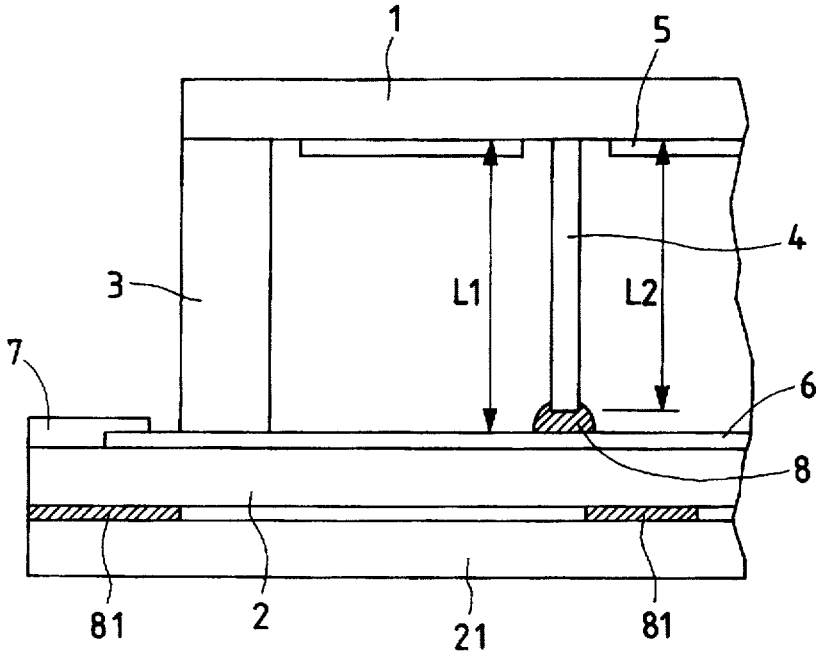
FIG. 14 is an enlarged schematic partial view of the embodiment of FIG. 13, showing part of the embodiment in greater detail.

FIG. 14 is an enlarged schematic partial view of the image-forming apparatus of FIG. 13, showing part of the lateral wall thereof and its vicinity in greater detail. The wiring section of the electron-emitting devices 6 of the apparatus was drawn out of the vacuum container through a lower portion of the support frame 3 and connected to a drive circuit by way of an extended wiring section 7.

Of the apparatus of this example, face plate 1, the rear plate 2 and the support frame 3 were formed by cutting panels of soda lime glass. Anti-atmospheric-pressure spacers 4 were prepared by polishing panel-shaped thin pieces of glass. The image-forming member 5 of the face plate 1 was prepared in a manner as in the case of Example 1 above.

In FIG. 14, L1 indicates the distance between the face plate 1 and the rear plate 2 defined by the support frame 3 while L2 is the height of each anti-atmospheric-pressure spacer 4. As seen from FIG. 14, L1 is greater than L2 or L1>L2, and the gap defined by L1-L2 was 250 μm and it was filled with frit glass 8. As in the case of Example 1, a given number of surface conduction electron-emitting devices 6 were prepared on the rear plate 2.

Again, as in the case of Example 1, the face plate 1, the rear plate 2, the anti-atmospheric-pressure spacers 4 and the composite rear plate (comprising component rear plates 2 and a reinforcing plate 21 as integral parts thereof) were assembled to produce a large image-forming apparatus.

Since the composite rear plate was formed by using soda lime glass and only a single thermal expansion coefficient was involved there, it did not show any distortions when assembled.

After the assembling operation, the inside of the vacuum container of the image-forming apparatus was evacuated through an exhaust pipe (not shown), which was then hermetically sealed.

By using anti-atmospheric-pressure spacers having a height smaller than the distance between the face plate 1 and the rear plate 2 defined by the support frame 3 as described above, the rear plate 2 could be aligned with the face plate 1 carrying thereon anti-atmospheric-pressure spacers 4 and a support frame 3 without any risk of damaging the electron-emitting devices and the image-forming member of the apparatus. Additionally, small errors, if any, in the height of the anti-atmospheric-pressure spacers could be neglected during the operation of assembling the image-forming apparatus.

The image-forming apparatus prepared in this way was highly shock-proof and operated stably for a prolonged period of time in displaying images on its large screen. While a pair of component rear plates were bonded together to produce a composite rear plate in this example, more than two component rear plates may be used to realize a large display screen.

EXAMPLE 3

Figure 15:
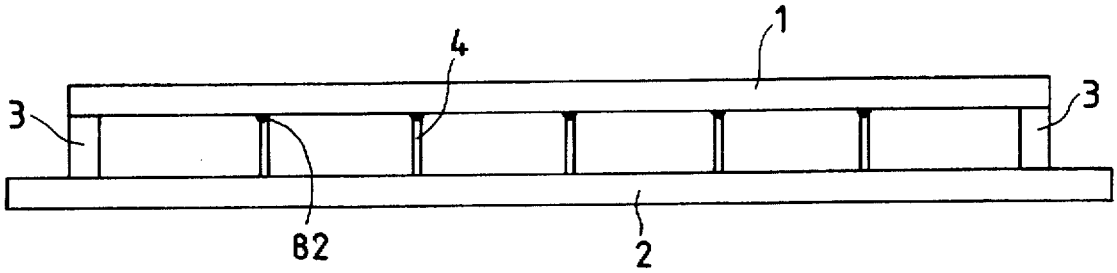
FIG. 15 is a schematic sectional side view of still another embodiment of an image-forming apparatus according to the invention.
Figure 16:
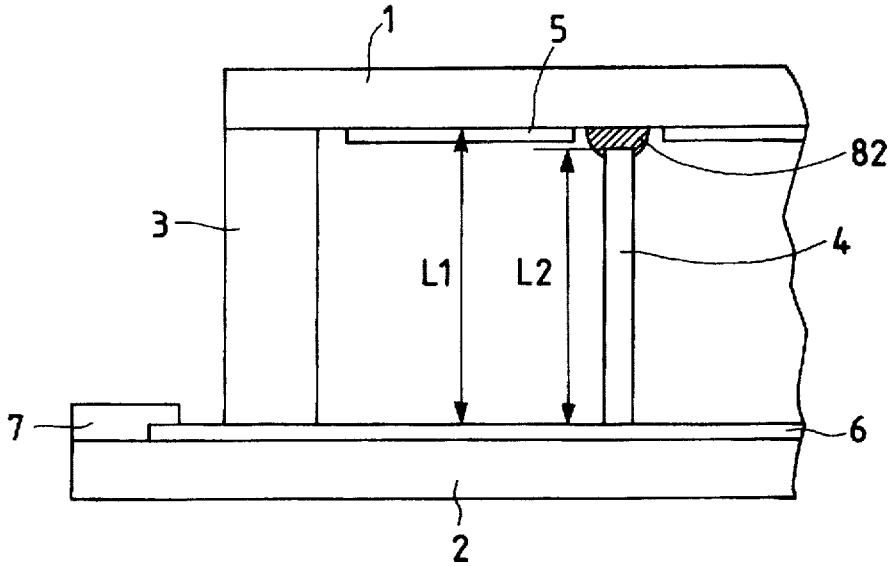
FIG. 16 is an enlarged schematic partial view of the embodiment of FIG. 15, showing part of the embodiment in greater detail.

In this example, an image-forming apparatus having a configuration schematically shown in FIG. 15 was prepared. As seen from FIG. 15, the image-forming apparatus comprised a face plate 1, a rear plate 2, a support frame 3 and a number of spacers 4 having a height smaller than the distance between the face plate 1 and the rear plate 2 defined by the support frame 3 and the gap between each spacer 4 and the face plate 1 was filled with frit glass 82. FIG. 16 is an enlarged schematic partial view of the image-forming apparatus of FIG. 15, showing part of the lateral wall thereof and its vicinity in greater detail. Note that the same components are denoted respectively by the same reference numerals and symbols in FIGS. 15 and 16. In this example, the distance L1-L2 was 100 μm and the gap between each spacer 4 and the face plate 1 was filled with frit glass 82. The face plate 1 carried thereon electron-emitting devices 6, wirings and an image-forming member 5, which were prepared in a manner the same as in Example 1 above.

Now, the process of assembling an image-forming apparatus of this example will be described by referring to FIGS. 17A through 17D.

Black frit glass 82 (LS-0118: available from Nippon Electric Glass Co., Ltd.) was applied to each of anti-atmospheric-pressure spacers 4 only in an area that was made to contact with the face plate 1 and the applied frit glass was calcined in order to remove the resin contained in the frit glass. The calcining operation was carried out by keeping the frit glass under a heated condition, where the black frit glass having a softening temperature of 390° C. was held to 380° C. for approximately ten minutes. The frit glass showed a thickness (or the distance between the front end of each piece of frit glass to be applied to an anti-atmospheric-pressure spacer 4 and the corresponding end face of the spacer 4) of 120 μm after the calcining operation. Note that each piece of frit glass applied to a spacer 4 to bond the face plate and the spacer needs to be made as narrow as possible in order to minimize its adverse affect on the quality of images to be displayed. More specifically, each piece of frit glass applied to a spacer 4 preferably has a thickness of between 100 and 200 μm in order to minimize the width of the frit glass after the calcining operation so that the image-forming member remains intact when the face plate and the rear plate are put together.

Thereafter, a given number of anti-atmospheric-pressure spacers 4 to which frit glass 82 had been applied were securely fitted to the rear plate 2 bearing thereon electron-emitting devices and wirings in a manner as will be described below.

Figure 17A:
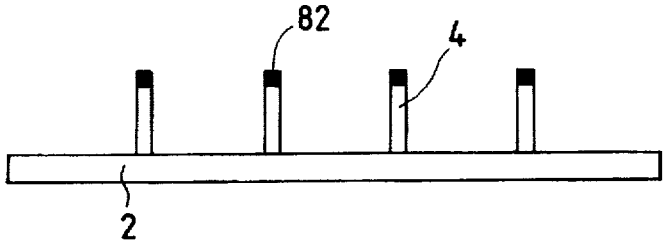
FIGS. 17A through 17D are schematic sectional side views of still another embodiment of an image-forming apparatus according to the invention, illustrating different steps of manufacturing the same.

Firstly, frit glass was applied onto the rear plate 2 by using a printing technique and the applied frit glass was calcined in order to remove the resin contained in the frit glass. The frit glass was crystalline and had a softening temperature of 400° C. The frit glass was one which could not be softened after baking even by heating it again to a temperature above the softening temperature. The calcining operation was carried out by keeping it under a heated condition, where the frit glass was held to 390° C. for approximately ten minutes. Thereafter, the anti-atmospheric-pressure spacers 4 were placed on the calcined frit glass to show a given pattern of arrangement. Then, the frit glass was baked as it was heated at 450° C. and kept under a heated condition for approximately ten minutes so that the spacers 4 were rigidly bonded to the rear plate 2 (FIG. 17A).

Figure 17B:
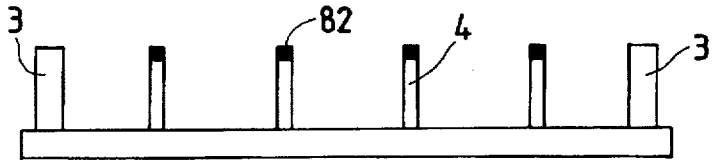

Then, a support frame 3 was bonded to the rear plate 2 also in a manner as described above. Here, frit glass having a softening temperature of 390° C. was calcined at 380° C. and baked at 430° C. for approximately ten minutes under a heated condition (FIG. 17B).

Figure 17C:
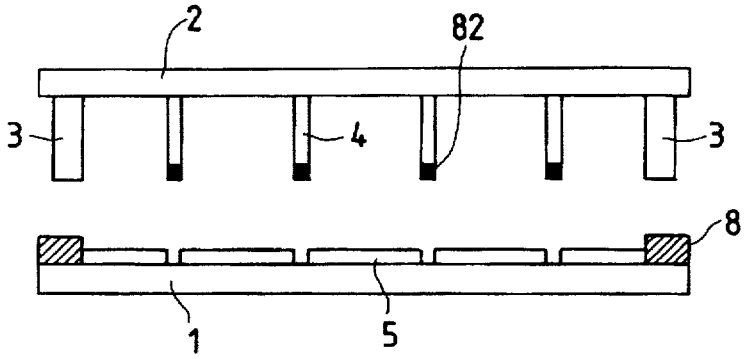

Thereafter, frit glass 8 was applied onto the face plate 1 over an area for receiving the support frame 3 by using a printing technique and then calcined under a heated condition, where the frit glass having a softening temperature of 390° C. was held to 380° C. for approximately ten minutes. The frit glass showed a thickness of about 400 μm after the calcining operation (FIG. 17C).

Figure 17D:
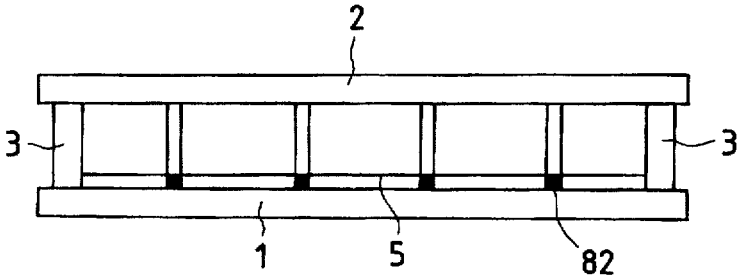

Subsequently, the support frame 3 and the spacers 4 were aligned with the face plate 1 and rigidly fitted thereto (FIG. 17D).

Since each of the anti-atmospheric-pressure spacers 4 had a height smaller than that of the support frame 3, the anti-atmospheric-pressure spacers 4 did not touch the fluorescent body so that the face plate 1 allowed fine positional adjustment to be conducted on the rear plate 2 after it had been preliminarily aligned with the rear plate 2.

Then, the frit glass was baked as it was heated at 430° C. and kept under a heated condition for approximately ten minutes. Since the frit glass 8 applied under the support frame 3 had a softening temperature equal to that of the frit glass 82 applied under the anti-atmospheric-pressure spacers 4, they were softened as they were baked and the frit glass 8 located between the rear plate 2 and the support frame 3 partly lost its height until the anti-atmospheric-pressure spacers 4 came to touch the softened frit glass. Consequently, the anti-atmospheric-pressure spacers 4 and the calcined frit glass (hard frit glass) were relieved from any significant impact (and practically no impact was experienced) and the frit glass 82 was found surrounding the anti-atmospheric-pressure spacers 4 when it was baked.

After the assembling operation was over, the vacuum container of the image-forming apparatus was evacuated by means of an exhaust pipe (not shown), which was then hermetically sealed to maintain the vacuum condition within the container. The finished image-forming apparatus had a structure capable of withstanding the atmospheric pressure.

By using anti-atmospheric-pressure spacers having a height smaller than the distance between the face plate 1 and the rear plate 2 defined by the support frame 3 as described above, the rear plate 2 could be aligned with the face plate 1 while carrying thereon anti-atmospheric-pressure spacers 4 and a support frame 3 without any risk of damaging the image-forming member of the apparatus including the black member. Additionally, small errors, if any, in the height of the anti-atmospheric-pressure spacers could be neglected during the operation of assembling the image-forming apparatus and no distortions were observed in the produced image-forming apparatus.

EXAMPLE 4

Figure 18:
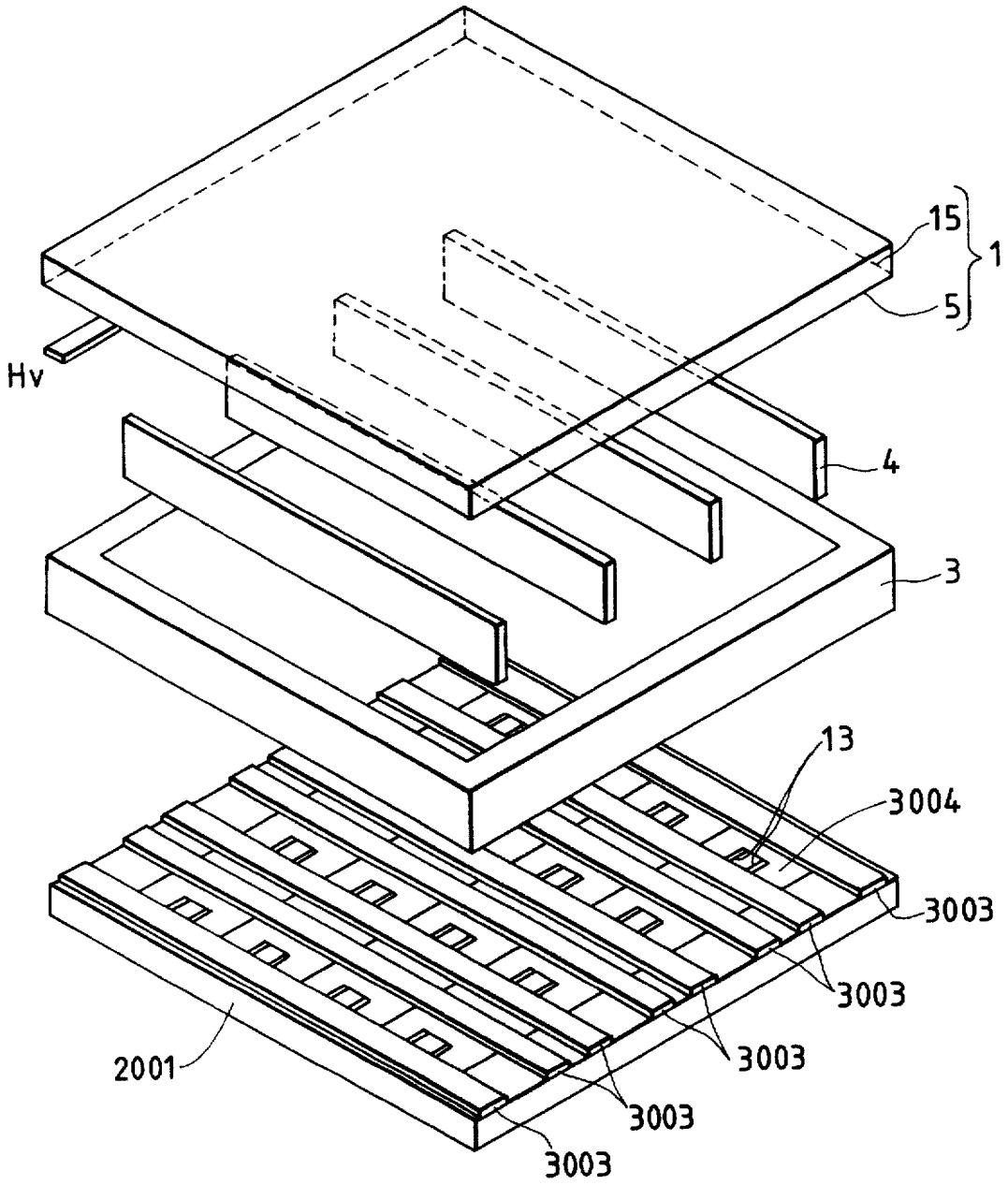
FIG. 18 is an exploded schematic perspective view of still another embodiment of an image-forming apparatus according to the invention.

In this example, an image-forming apparatus having a configuration schematically shown in FIG. 18 was prepared. As seen from FIG. 18, the image-forming apparatus comprised a glass substrate 2001, a support frame 3 and a number of anti-atmospheric-pressure spacers 4. Reference numeral 15 denotes a glass plate, on the inner surface of which glass plate 15 an image-forming member 5 was formed to become a face plate 1 of the apparatus. Each of the anti-atmospheric-pressure spacers 4 was blackened at an end face to be fitted to the face plate 1.

Figure 19:
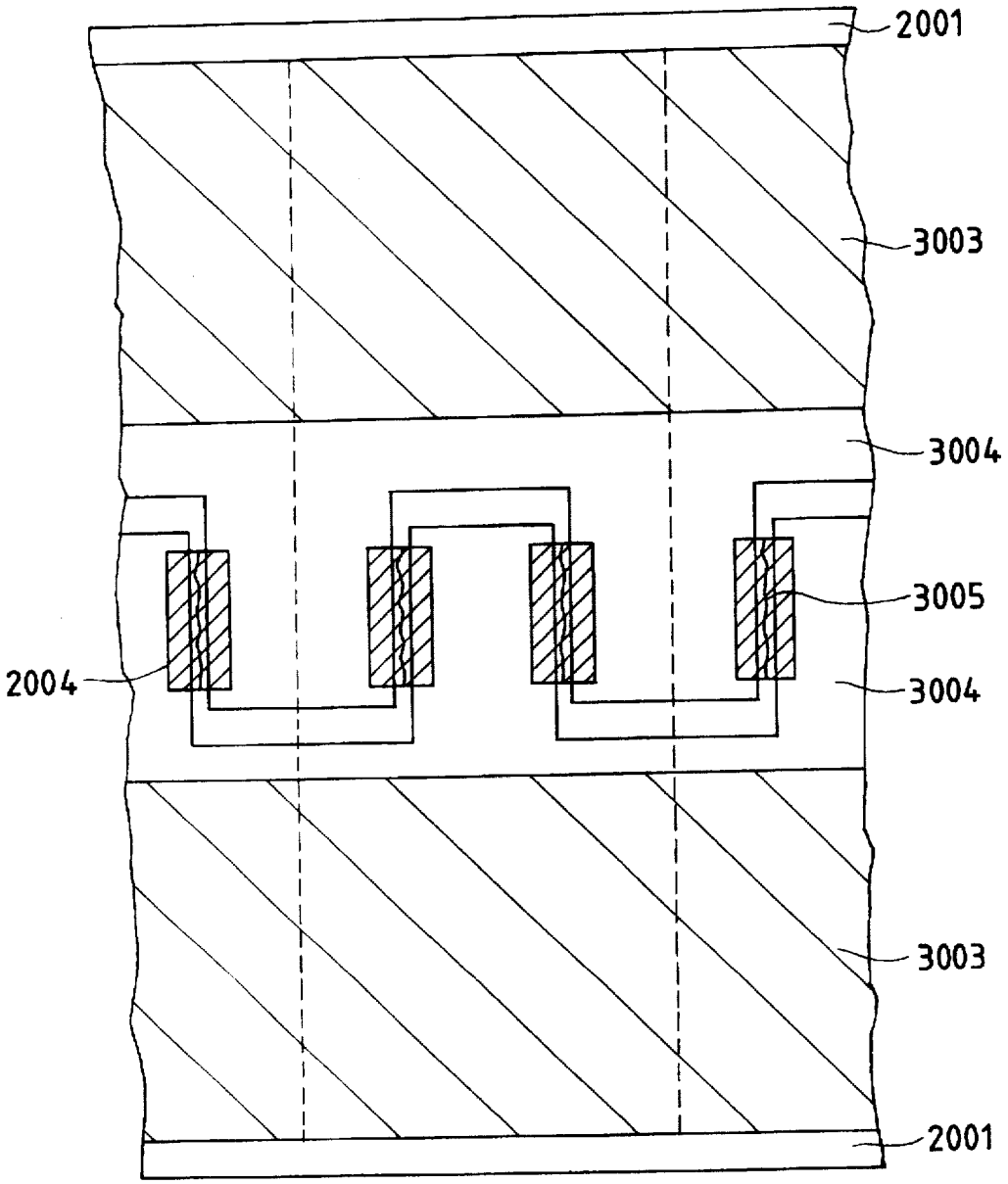
FIG. 19 is an enlarged partial plan view of the embodiment of FIG. 18.
Figure 20:
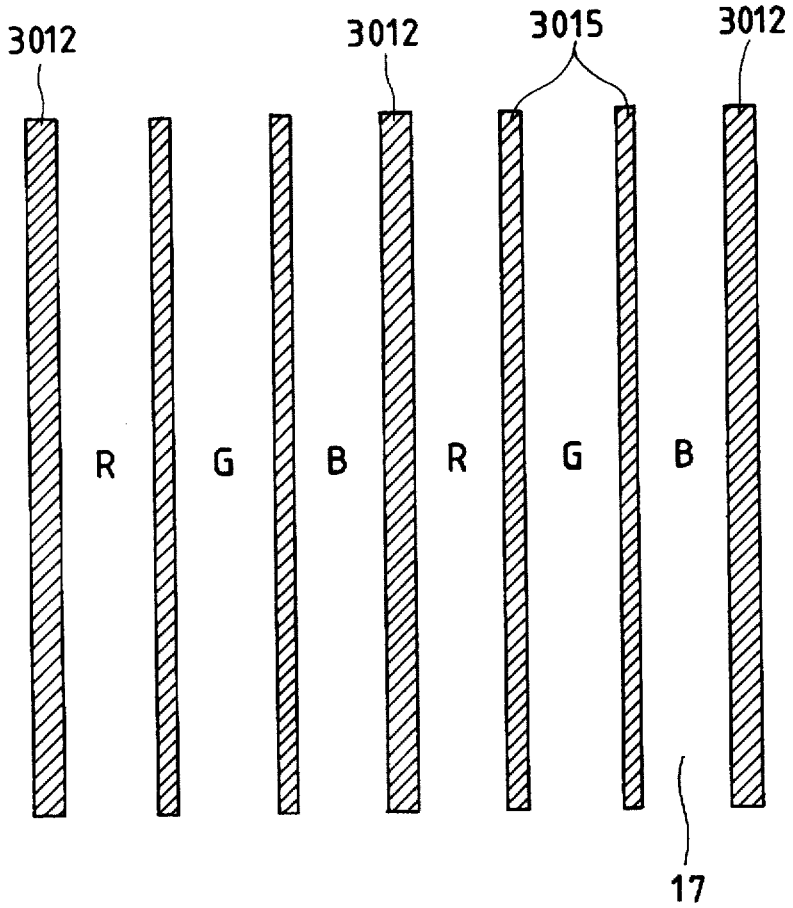
FIG. 20 is a schematic plan view of black stripes, showing a possible arrangement thereof that can be used for the purpose of the present invention.

The image-forming apparatus of this example was prepared in a manner as described below by referring to FIGS. 18, 19 and 20, of which FIG. 19 is an enlarged partial plan view of the apparatus of FIG. 18 illustrating the electron source substrate of the rear plate thereof and FIG. 20 is a schematic view showing an arrangement of black stripes.

(1) After thoroughly cleansing a glass substrate 2001 with an organic solvent, a plurality of device sections 3004 were formed on the substrate to a thickness of 1,000 Å, using Ni, by means of photolithography (FIGS. 18 and 19). Wiring sections 3003 for feeding the device sections with power were also formed to a thickness of 2 μm, using Ag, by means of a printing technique. The wirings showed a pattern of parallel lines as illustrated in FIG. 18 and were arranged in such a way that a number of devices were fed with power commonly by way of a pair of adjacently located wirings 3003. Modulation electrodes (not shown), each having a through bore with a diameter of 50 μm for allowing electrons to pass therethrough, were arranged 10 μm above the substrate 2001 with an insulation layer of $SiO_2$ disposed therebetween.

(2) Thereafter, a solution containing an organic palladium compound (ccp4230: available from Okuno Pharmaceutical Co., Ltd.) was applied to the electrodes and heated at 300° C. for ten minutes to produce a thin film consisting of fine particles of palladium oxide (PdO). Then the product was subjected to a patterning operation, using a dry etching technique, to form an electroconductive thin film 2004 in each device section 3004.

(3) Then, a given voltage was applied to each device section 3004 to treat the conductive thin film 2004 in an electric forming process (hereinafter simply referred to as forming process) and form an electron-emitting section in the device section 3004.

(4) Thereafter, the face plate 1 of the apparatus was prepared in a manner as described below.

After cleansing a glass substrate 3009, a number of black stripes 3015 were formed thereon by photolithography (FIG. 20). The black stripes contained graphite as a principal ingredient. Then, phosphors of three primary colors 3013 were mixed resist separately to produce slurry mixtures of the three colors and subsequently each of the mixtures was applied to given areas of the substrate, developed and fixed to produce a fluorescent display surface as in the case of an ordinary CRT. The produced fluorescent body 17 had an even thickness between 20 and 30μm and did not show any defects such as peeled and/or unevenly distributed phosphor.

(5) Then, the surface of the fluorescent body 17 was subjected to a smoothing operation called filming and aluminum (Al) was deposited by vacuum deposition on the inner surface of the fluorescent body to a thickness of about 2,000 Å to produce a so-called metal back (not shown).

(6) A number of anti-atmospheric-pressure spacers 4 were prepared in a manner as described below.

In this example, a flat glass plate was cut into pieces having a height of 5 mm and a thickness of 0.2 mm. Then, a given number of pieces of glass 4 were arranged such that their end faces to be made to abut the face plate were found in the same plane and a plurality of pieces were put together to form a multilayer structure, whose surface was made gritty by means of a sand blast technique. Thereafter, a black paint was sprayed onto the gritty surfaces of the multilayer structures to produce intended anti-atmospheric-pressure spacers.

(7) The rear plate 2001 bearing thereon a number of electron-emitting devices 13 and the face plate 1 were arranged vis-a-vis with a plurality of anti-atmospheric-pressure spacers 4 and a support frame 3 disposed therebetween and frit glass was applied to the areas to be connected together. Then, the components were firmly put together and baked at 400° C. in the atmosphere for more than ten minutes to produce a hermetically sealed container. The anti-atmospheric-pressure spacers 4 were so arranged as to abut the respective wiring 3003 between any two adjacent rows of electron-emitting devices on the side of the electron source substrate 2 and the respective black stripes 3012 that were relatively wide on the side of the face plate 1. With such an arrangement, the anti-atmospheric-pressure spacers 4 did not obstruct electron beams emitted from the electron-emitting devices 13 to irradiate the fluorescent body 17.

(8) The prepared glass container (comprising the electron source substrate 2, the support frame 3 and the face plate 1) was evacuated through an exhaust pipe (not shown) by means of a vacuum pump to achieve a sufficient degree of vacuum, or about $10^{-6}$ torr. Subsequently, the exhaust pipe was heated and molten by means of a gas burner to produce a hermetically sealed container.

(9) Finally, the container assembly was subjected to a getter process in order to maintain the inside at a satisfactory level of vacuum. This is a process where a getter (not shown) that has been arranged in advance at a given position within the container assembly of an image-forming apparatus is heated typically by means of a resistance heater or a high frequency induction heater to produce a film of the material of the getter by deposition. A getter typically contains barium as a principal ingredient and the deposited film of the getter can maintain the inside of a hermetically sealed vessel to an enhanced degree of vacuum through its adsorption effect.

When a designated voltage was applied to the electron-emitting devices of the image-forming apparatus by way of external terminals, they emitted electrons. The emitted electrons then passed through the through bores of the modulation electrodes (not shown) and were caused to strike and energize the fluorescent body 17 until it started to glow as the emitted electrons were accelerated by a voltage as high as more than several kV applied to the metal back or transparent electrodes (not shown) by way of a high voltage terminal Hr. By simultaneously applying a voltage that varies as a function of the input signal to the modulation electrodes, the electron beams passing through the through bores could be controlled so as to display images on the screen.

The image-forming apparatus prepared in this example operated quite well to produce images of a good quality even though some of the black stripes had been partially peeled off in the course of preparation.

EXAMPLE 5

Figure 21:
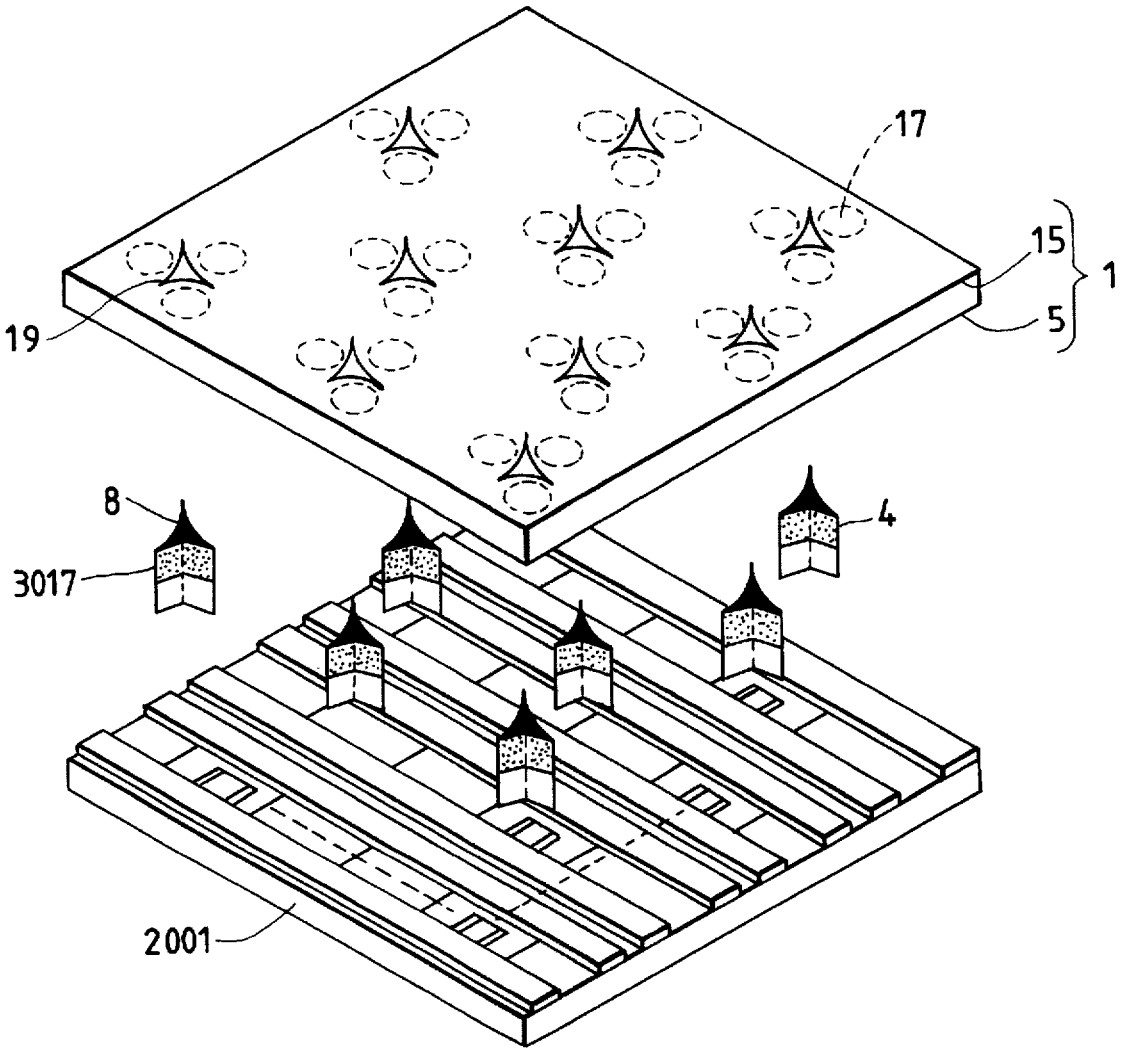
FIG. 21 is an exploded schematic perspective view of still another embodiment of an image-forming apparatus according to the invention.
Figure 22:
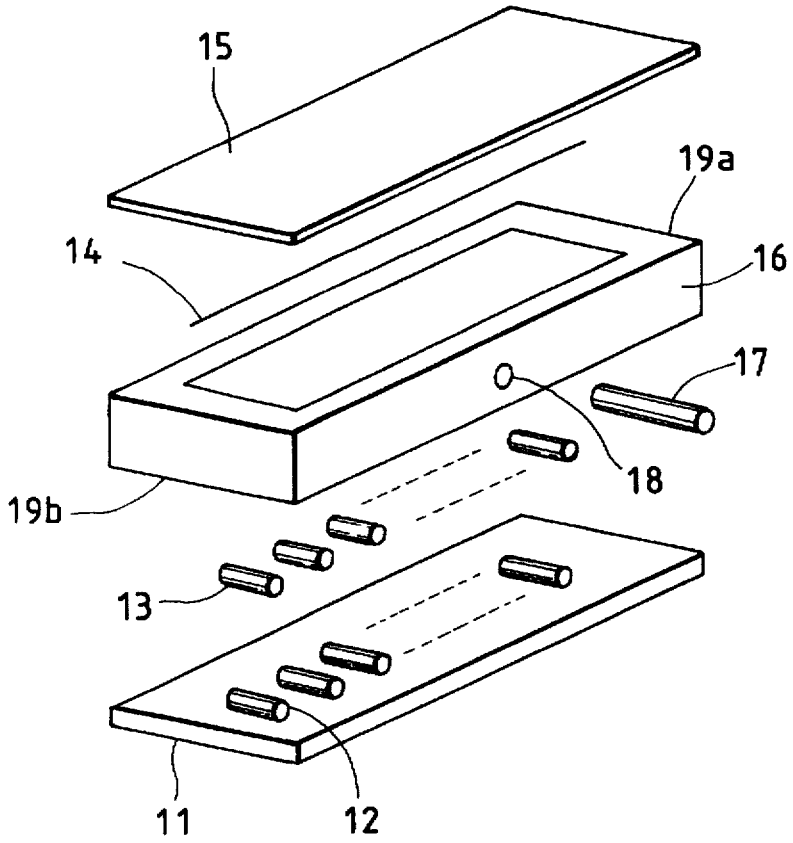
FIG. 22 PRIOR ART
FIG. 22 is an exploded schematic perspective view of a conventional flat display.

In this example, an image-forming apparatus having a configuration as schematically shown in FIG. 21 was prepared. The image-forming apparatus of FIG. 21 differs from that of Example 4 only in that the arrangement of spacers 4 was different from that of the apparatus of Example 4.

Since the electron-emitting devices on the electron source substrate 2 and the image-forming member 5 were formed in a manner the same as that of Example 4, they would not be described here any further. The technique of sealing the container assembly was also the same as that of Example 4.

In this example, the fluorescent body 17 has a form of so-called delta arrangement. In FIG. 21, reference numeral 19 denotes a matrix pattern and reference numeral 3016 denotes black members, which are called a black matrix when they are arranged as in FIG. 21. If a delta arrangement is used for the fluorescent body and any two adjacent pieces of phosphor of a same color are separated from each other, the horizontal distance between them offers the advantageous merit that the resolution of the displayed images is improved in the horizontal direction to produce fine and well defined images.

The anti-atmospheric-pressure spacers 4 of this example were, unlike the flat spacers of the apparatus of Example 4, realized in the form of columns having a triangular cross section as shown in FIG. 21. A thin film 3017 was formed by vapor deposition on the top side of each of the columns that was to be made to abut the face plate and black frit glass 8 was applied on the top of the thin film. Then the spacer columns were arranged on the black matrix in such a way that the points of the triangular cross section of each column were located in respective spaces separating the corresponding dots of the matrix pattern 19 as shown in FIG. 21. Thereafter, the anti-atmospheric-pressure spacers were calcined at 300° C. in order to rigidly secure them to the face plate 1.

The face plate 1 to which the anti-atmospheric-pressure spacers 4 had been secured and the electron source substrate 2 on which the electron-emitting devices 13 had been formed were then aligned so that the color dots of the fluorescent body were placed in strict positional agreement with the corresponding electron-emitting devices and thereafter bonded together to a support frame (not shown) to produce a vacuum container of the image-forming apparatus.

Since the anti-atmospheric-pressure spacers 4 were rigidly secured to the face plate 1 of this image-forming apparatus, the image-forming member 5 would not be damaged by any displaced spacers 4.

The image-forming apparatuses prepared in the above examples could be used as electron sources for image recording apparatuses that could reproduce fine and well defined images.

What is claimed is:

1. An image-forming apparatus comprising:

a rear plate bearing thereon electron-emitting devices;

a face plate bearing thereon an image-forming member and arranged vis-a-vis said rear plate;

a support frame arranged between said rear plate and said face plate to enclose the periphery of the space delimited by said plates and define the distance therebetween; and spacers arranged between said face plate and said rear plate, separately and independently from said support frame, and designed to produce images on said image-forming member by irradiating said image-forming member with electrons emitted from said electron-emitting devices;

wherein said spacers are shorter than the support frame in the direction normal to the surfaces of said face plate and said rear plate and said spacers are rigidly bonded at least at an end thereof to said rear plate or said face plate by means of an adhesive agent.

2. An image-forming apparatus according to claim 1, wherein said adhesive agent is frit glass.

3. An image-forming apparatus according to claim 1, wherein said adhesive agent is arranged on a black member formed on said face plate.

4. An image-forming apparatus according to claim 1, wherein said rear plate bears thereon said electron-emitting devices arranged in the form of a matrix.

5. An image-forming apparatus according to claim 4, wherein said adhesive agent is applied to a matrix of wirings arranged for electrically connecting said electron-emitting devices arranged in a matrix.

6. An image-forming apparatus according to claim 4, wherein said electron-emitting devices are surface conduction electron-emitting devices.

7. An image-forming apparatus comprising:

a rear plate bearing thereon electron-emitting devices;

a face plate bearing thereon an image-forming member and arranged vis-a-vis said rear plate;

a support frame arranged between said rear plate and said face plate to enclose the periphery of the space delimited by said plates and define the distance therebetween; and spacers arranged between said face plate and said rear plate and designed to produce images on said image-forming member by irradiating said image-forming member with electrons emitted from said electron-emitting devices;

wherein said spacers are shorter than the distance between said face plate and said rear plate defined by said support frame and said spacers are rigidly bonded at least at an end thereof to said rear plate or said face plate by means of an adhesive agent, wherein the difference between the distance separating said rear plate and said face plate as defined by said support frame and the height of each of said spacers is between 50 and 500 μm.

8. An image-forming apparatus according to claim 7, wherein said adhesive agent is frit glass.

9. An image-forming apparatus according to claim 7, wherein said adhesive agent is arranged on a black member formed on said face plate.

10. An image-forming apparatus according to claim 7, wherein said rear plate bears thereon said electron-emitting devices arranged in the form of a matrix.

11. An image-forming apparatus according to claim 10, wherein said adhesive agent is applied to a matrix of wirings arranged for electronically connecting said electron-emitting devices arranged in a matrix.

12. An image-forming apparatus according to claim 10, wherein said electron-emitting devices are surface conduction electron-emitting devices.

13. An image-forming apparatus comprising:

a rear plate bearing thereon electron-emitting devices;

a face plate bearing thereon an image-forming member and arranged vis-a-vis said rear plate;

a support frame arranged between said rear plate and said face plate to enclose the periphery of the space delimited by said plates and define the distance therebetween; and spacers arranged between said face plate and said rear plate and designed to produce images on said image-forming member by irradiating said image-forming member with electrons emitted from said electron-emitting devices;

wherein said spacers are shorter than the distance between said face plate and said rear plate defined by said support frame and said spacers are rigidly bonded at least at an end thereof to said rear plate or said face plate by means of an adhesive agent, wherein the materials of said support frame, said face plate and said rear plate are selected from materials showing a ratio of thermal expansion coefficients between 0.8 and 1.2 between any two of them.

14. An image-forming apparatus according to claim 12, wherein said adhesive agent is frit glass.

15. An image-forming apparatus according to claim 13, wherein said adhesive agent is arranged on a black member film formed on said face plate.

16. An image-forming apparatus according to claim 13, wherein said rear plate bears thereon said electron-emitting devices arranged in the form of a matrix.

17. A image-forming apparatus according to claim 16, wherein said adhesive agent is applied to a matrix of wirings arranged for electronically connecting said electron-emitting devices arranged in a matrix.

18. An image-forming apparatus according to claim 16, wherein said electron-emitting devices are surface conduction electron-emitting devices.

19. An image-forming apparatus according to any of claims 1, 7 or 13, wherein said rear plate comprises two component rear plates that are bonded together.

20. An image-forming apparatus according to any of claims 1, 7 or 13, wherein said spacers are bonded only to said face plate by means of the adhesive agent.

21. An image-forming apparatus according to any of claims 1, 7 or 13, wherein said spacers are bonded only to said rear plate by means of the adhesive agent.

22. An image-forming apparatus according to any of claims 1, 7 or 13, wherein said spacers are bonded both to said face plate and to said rear plate by means of the adhesive agent.

23. An image-forming apparatus according to any of claims 1, 7 or 13, wherein said adhesive agent is a black adhesive agent.

24. An image-forming apparatus according to any of claims 1, 7 or 13, wherein each of said spacers is blackened at an end face to be fitted to the face plate.

25. An image-forming apparatus according to any of claims 1, 7 or 13, wherein said spacers are in the form of columns.

26. An image-forming apparatus according to claim 25, wherein said spacers in the form of columns have a triangular cross-section.

27. An image-forming apparatus according to any of claims 1, 7 or 13, wherein said spacers comprise panel-shaped thin pieces.

28. An image-forming apparatus according to claim 7 or 13, wherein said spacers and said support frame are formed into an integral structure.

29. An image-forming apparatus according to claim 7 or 13, wherein said spacers and said support frame are provided as separate and independent components.

* * * * *

UNITED STATES PATENT AND TRADEMARK OFFICE

CERTIFICATE OF CORRECTION

PATENT NO. : 5,734,224

DATED : March 31, 1998

INVENTOR(S) : MASAHIRO TAGAWA, ET AL.

It is certified that error appears in the above-identified patent and that said Letters Patent is hereby corrected as shown below:

COLUMN 8:

Line 47, "Dox 1" should read --Doxl--.

Line 48, "Doy 1" should read --Doyl--.

Line 49, "Dox 1" should read --Doxl--.

Line 54, "Doy 1" should read --Doyl--.

COLUMN 19:

Line 13, "claim 12," should read --claim 13,--.

Line 17, "film" should be deleted.

Signed and Sealed this

Sixth Day of October, 1998

*Attest:*

*Attesting Officer*

BRUCE LEHMAN

*Commissioner of Patents and Trademarks*